US010124918B2

(12) United States Patent
Scheu

(10) Patent No.: US 10,124,918 B2
(45) Date of Patent: Nov. 13, 2018

(54) METHOD AND APPARATUS FOR DOSING PRODUCTS

(75) Inventor: Volker Scheu, Niederzier (DE)

(73) Assignee: SIG TECHNOLOGY AG, Neuhausen am Rheinfall (CH)

( * ) Notice: Subject to any disclaimer, the term of this patent is extended or adjusted under 35 U.S.C. 154(b) by 0 days.

(21) Appl. No.: 12/989,291

(22) PCT Filed: Mar. 30, 2009

(86) PCT No.: PCT/DE2009/000445
§ 371 (c)(1),
(2), (4) Date: Dec. 29, 2010

(87) PCT Pub. No.: WO2009/129768
PCT Pub. Date: Oct. 29, 2009

(65) Prior Publication Data

US 2011/0121014 A1 May 26, 2011

(30) Foreign Application Priority Data

Apr. 22, 2008 (DE) ..... 10 2008 020 751

(51) Int. Cl.

| | |
|---|---|
| ***B65D 83/00*** | (2006.01) |
| ***B65G 59/00*** | (2006.01) |
| ***B65B 3/36*** | (2006.01) |
| ***B65B 1/42*** | (2006.01) |
| ***B65B 39/00*** | (2006.01) |

(52) U.S. Cl.
CPC ..... *B65B 3/36* (2013.01); *B65B 1/42* (2013.01); *B65B 39/003* (2013.01)

(58) Field of Classification Search
CPC ..... B65D 47/263; A47F 7/281; B65B 1/42; B65B 3/36; B65B 39/003
USPC ..... 221/151, 263–265, 233, 237, 299, 301, 221/196
See application file for complete search history.

(56) References Cited

U.S. PATENT DOCUMENTS 663,136 A * 12/1900 Straube ..... B65B 1/42 141/267
1,389,060 A * 8/1921 Lippitz ..... A01C 9/04 221/174

(Continued)

FOREIGN PATENT DOCUMENTS

DE 252905 A 10/1912
DE 1294054 B 4/1969

(Continued)

*Primary Examiner* — Michael Collins
(74) *Attorney, Agent, or Firm* — Lucas & Mercanti, LLP; Klaus P. Stoffel

(57) ABSTRACT

Disclosed are a method and an apparatus for dosing products, a predefined amount of which is fed to a package. The dosed amount is defined by opening and closing at least one valve (1). A sleeve-type blocking element (4, 5) is arranged in a housing (3) of said valve (1). By placing said at least one blocking element (4, 5) in a manner that can be controlled or regulated, at least one recess (9, 10) located in the zone of lateral surfaces (7, 8) of the blocking element (4, 5) is disposed in such a way as to create an open or closed position and define a cross-section of an outlet 12). Preferably, the blocking elements (4, 5) are coaxially arranged relative to one another.

18 Claims, 2 Drawing Sheets

(56) References Cited

U.S. PATENT DOCUMENTS

| | | | | | |
|---|---|---|---|---|---|
| 1,415,937 | A * | 5/1922 | Lippitz | A01C 9/04 | 221/115 |
| 1,524,431 | A * | 1/1925 | Grady | B65B 1/42 | 141/73 |
| 1,841,926 | A * | 1/1932 | Zuehl | 221/75 | |
| 2,126,425 | A | 8/1938 | Thompson et al. | | |
| 2,220,175 | A * | 11/1940 | Rice | 221/151 | |
| 2,434,222 | A * | 1/1948 | Olivier | 221/196 | |
| 3,893,593 | A * | 7/1975 | Hazard | B65D 47/265 | 215/204 |
| 4,023,511 | A * | 5/1977 | Newman | A01C 5/045 | 111/89 |
| 4,167,367 | A * | 9/1979 | Van Mechelen | F03B 1/00 | 415/151 |
| 4,403,691 | A * | 9/1983 | Kageyama | A45C 11/34 | 206/214 |
| 4,407,312 | A * | 10/1983 | Davila et al. | 453/32 | |
| 4,893,728 | A * | 1/1990 | Jennings et al. | 221/306 | |
| 6,827,899 | B2 * | 12/2004 | Maisey et al. | 422/430 | |
| 2002/0185498 | A1 * | 12/2002 | Riordan et al. | 221/196 | |
| 2004/0104241 | A1 * | 6/2004 | Broussard et al. | 221/289 | |

FOREIGN PATENT DOCUMENTS

| | | | |
|---|---|---|---|
| DE | 3637550 | A1 | 5/1988 |
| DE | 3918008 | C1 | 9/1990 |
| DE | 4200336 | | 7/1993 |
| DE | 10301356 | A1 | 7/2004 |
| WO | 85/04641 | A | 10/1985 |

* cited by examiner

METHOD AND APPARATUS FOR DOSING PRODUCTS

This application is a 371 of PCT/DE2009/000445 filed Mar. 30, 2009, which in turn claims the priority of DE 10 2008 020 751.9 filed Apr. 22, 2008, the priority of these applications is hereby claimed and these applications are incorporated by reference herein.

BACKGROUND OF THE INVENTION

The invention relates to a method for metering products which are conveyed in a predetermined quantity to a package and in which a metered quantity is determined by opening and closing at least one valve.

The invention additionally relates to a device for metering products which are conveyed in a predetermined quantity to a package wherein the device has at least one valve which controls or regulates a product flow by opening and closing a conveying path, and which includes a valve housing in which a blocking element is positionably arranged in the conveying path.

Such devices and methods are used, for example, for filling and/or metering quantities of pourable, flowable or pasty products or products with piece-like portions, particularly also of foodstuff, for example, products like beverages, other liquid or pasty foodstuffs, of piece-like foodstuffs and/or mixtures or conglomerates of the above-mentioned foodstuffs or products. For filling such products, it is usually necessary to make available a large opening cross-section and, when the valve is closed, the product should be cut off if at all possible. Such requirements, also particularly exist in the field of aseptic filling of foodstuffs. For such aseptic applications, so-called pin-openings are commonly used. In the non-aseptic range, it is known in the art to use roller outlets or similar devices.

However, the previously known methods and devices cannot meet all requirements which are made up of a quick, reliable and problem-free filling.

SUMMARY OF THE INVENTION

Therefore, it is the object of the present invention to improve the method of the above-mentioned type in such a way that a quick and reliable filling procedure is realized while the product to be filled is manipulated gently.

In accordance with the invention, this object is met by a controllable or regulatable positioning of at least one cylinder-like locking element arranged in a valve housing of the valve, at least one recess is arranged in the area of side surfaces of the locking element for making available an opening or closing position and for securing a cross-section of an outflow opening.

Another object of the present invention is to construct a device of the above-mentioned type in such a way that a quick and gentle filling of the product is facilitated while the mechanical configuration of the metering device is simple.

In accordance with the invention, this object is met by providing a first as well as a second blocking element each with a cylindrical configuration and with at least one recess in the area of side surfaces, and the blocking elements are arranged relative to each other essentially coaxially.

The method of the invention and the device according to the invention make it possible to adapt the size of the resulting outlet opening variably to the product to be filled and to change the position of the outlet opening in a suitable way and manner. For avoiding filling material to be adhering at the material outlet, it is possible that the outlet is moved in a closed position in such a way that possibly an overhanging product can be stripped off, for example, from the housing wall into a waiting package. Moreover, intersections of closing edges are made available which lead to a clean separation and/or cutting of the product and thereby the occurrence of squeezed material, which is undesirable especially when filling foods, is avoided. Moreover, mechanical stops are avoided, so that a corresponding wear is kept low.

Compared to a blocking valve the outlet according to the invention prevents the generation of a pressure when the valve device is opened within the filling chamber. Moreover, the outlet does on its outer side not come directly into contact with the product, so that a product adherence at the outlet is minimized. Finally, the required force for opening and closing the metering device is independent of the pressure within the filling chamber, so that a drive for the locking elements having relatively small dimensions is sufficient.

The compact construction is achieved by coaxially positioning the locking elements relative to each other.

A simple controllability can be facilitated by positioning the blocking elements relative to each other by a rotary movement.

Assembly and disassembly procedures are facilitated by arranging the blocking elements so as to be displaceable relative to each other in an axial direction.

Particularly advantageous metering possibilities are made available by mounting both blocking elements in a valve housing so as to be moveable.

For adapting to special metering tasks, it is proposed that, by arranging the locking elements relative to each other and relative to the valve housing, a size of the outlet opening is predetermined.

For predetermining a metering quantity, it has been found advantageous that by arranging the blocking elements relative to each other and relative to the valve housing, a positioning of the outlet opening is provided.

In particular, it is also intended that by an arrangement of the blocking elements relative to each other and relative to the valve housing a size as well as a positioning of the outlet opening is predetermined.

BRIEF DESCRIPTION OF THE DRAWINGS

In the drawings, embodiments of the invention are schematically illustrated. In the drawing

DETAILED DESCRIPTION OF THE INVENTION

Figure 1:
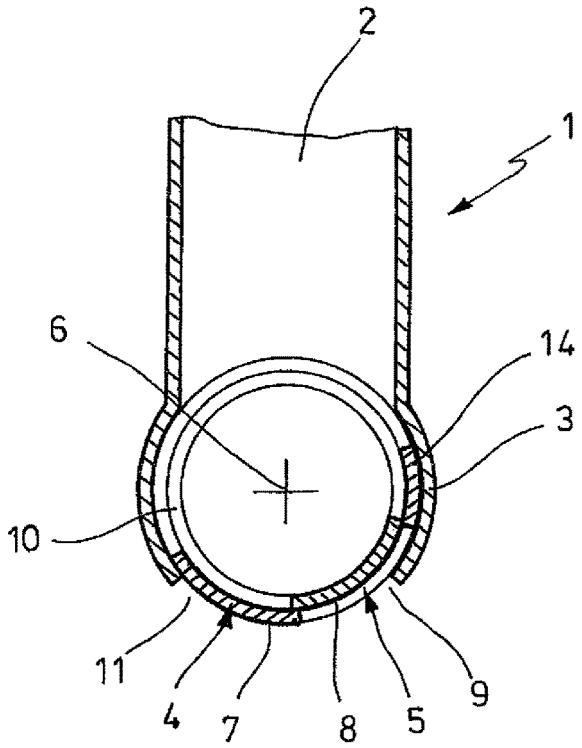
FIG. 1 is a cross-section of a valve with two sleeve-like locking elements arranged relative to each other essentially coaxially in a closed state of the valve.

In accordance with the embodiment of FIG. 1, the device for metering products is provided with a valve (1) which is arranged in the area of a conveying path (2). Within a valve housing (3) are arranged a first blocking element (4) and a second blocking element (5). Relative to a transverse axis (6), the blocking elements (4, 5) extend essentially coaxially relative to each other and in the manner of sleeves.

The arrangement of the structural elements takes place in such a way that the valve housing (3) is positioned on the outside and guides the first blocking element (4). The second locking element (5) is arranged within the first blocking element (4). The arrangement takes place especially in such a way that the first blocking element (4) is arranged so as to be moveable relative to the valve housing (3) and that the second blocking element (5) is moveably arranged within the first blocking element (4). In this connection, the mobility is realized by a rotatability of the structural elements relative to each other and about the transverse axis (6).

The blocking elements (4, 5) each have outer surfaces (7, 8) which are contoured in accordance with sections and segments of a cylinder wall. Respective recesses (9, 10) are arranged in the area of the outer surfaces (7, 8).

FIG. 1 shows an arrangement of the valve (1) in such a way that an outflow opening (11) of the valve housing (3) is closed by the outer surfaces (7, 8) of the blocking elements (4, 5). In this state of operation, it is not possible for product to be filled to emerge from the outlet opening (11).

Figure 2:
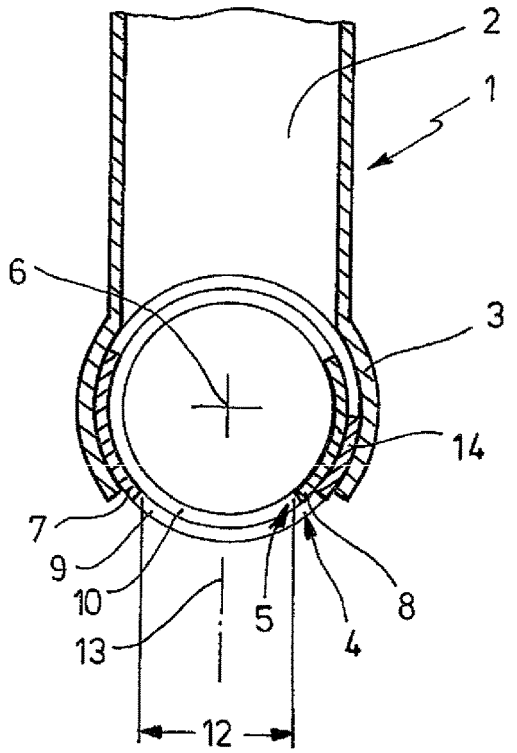
FIG. 2 shows the arrangement according to FIG. 1 in an opened state of the valve.

In accordance with the state of operations shown in FIG. 2, the blocking elements (4, 5) have been turned relative to each other and relative to the valve housing (3) about the transverse axis (6) in such a way that the outlet openings (11) are released. The recesses (9, 10) of the blocking elements (4, 5) and the outlet opening (11) overlap each other at least in sections. FIG. 2 illustrates especially that as a result of an appropriate positioning of the blocking elements (4, 5) relative to each other and relative to the valve housing (3) the size of the resulting outlet opening (12) as well as the positioning of a surface centerline (13) can be changed and varied relative to the valve housing (3).

The predetermination of the effective size of the outlet opening (12) and the orientation of the surface centerline (13) can be reinforced in accordance with the embodiment in FIGS. 1 and 2 in particular by the fact that the first blocking element (4) is equipped with an outer surface (7) as well an outer surface (14) which are arranged at a distance relative to each other in a circumferential direction and limit the recess (9).

A positioning of the blocking elements (4, 5) relative to each other and relative to the valve housing (3) can be effected manually or automatically. An automatic positioning is considered especially when electrical or pneumatic positioning elements are used which act on the blocking elements (4, 5) either directly or with the intermediate arrangement of couplings, gear systems or other connecting devices.

Figure 3:
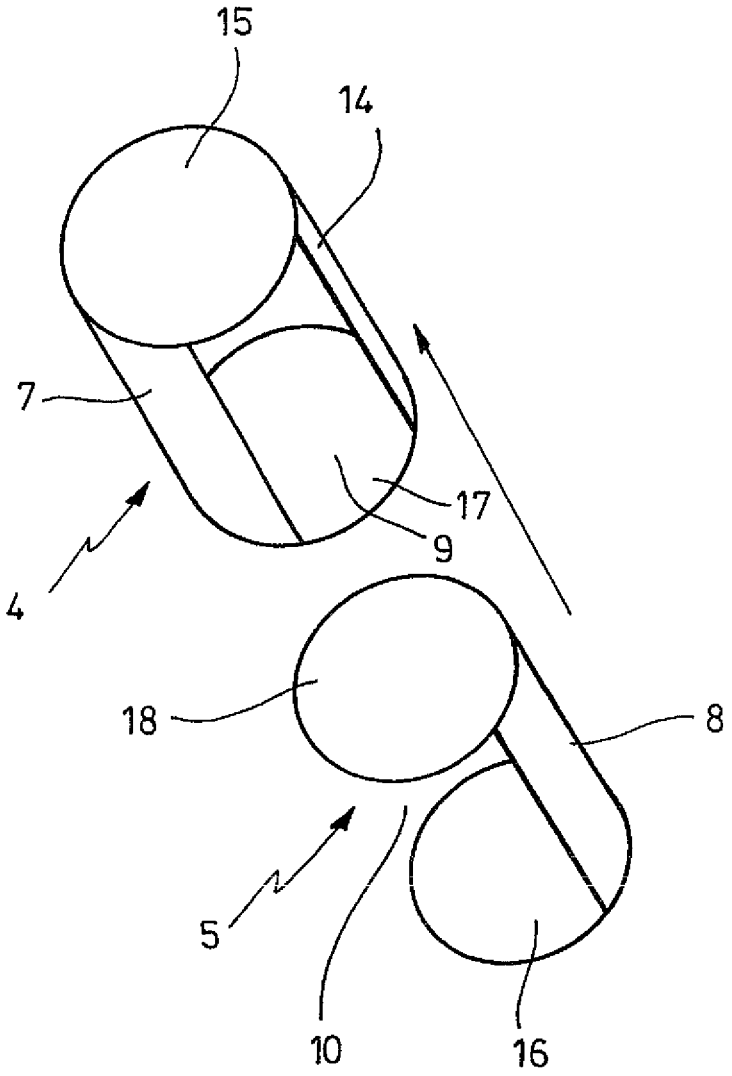
FIG. 3 is a perspective illustration of the two sleeve-like locking elements in a disassembled state.

FIG. 3 shows a perspective illustration of the two blocking elements (4, 5) which have been separated from each other and taken out of the valve housing (3). The cylindrical configuration of the blocking elements (4, 5) is further made clear as a result. In particular, it can be particularly seen that the blocking elements (4, 5) are each provided with a bottom (15, 16) and a cover (17, 18) at the ends of the respective cylindrical extensions. When the blocking elements (4, 5) are suitably sealed relative to the valve housing (3), it is not required that the bottoms (15, 16) and the covers (17, 18) have a closed surface configuration, but rather they can be constructed, for example, as guide rings or as another type of guide element.

The above explained sleeve-like configuration represents a particular embodiment of a cylindrical shape of the blocking elements (4, 5). Cylinder-like constructions encompass cone shaped or truncated cone-shaped configurations. The appropriate conical or cylindrical configuration can also be partially of solid construction, wherein through-channels extend in the solid construction.

As an alternative to making available the outlet opening by suitable rotary adjustment of the blocking elements (4, 5) it is also possible to provide the size and/or the position of the outlet opening by an axial positioning of the blocking elements (4, 5).

The invention claimed is:

1. A method for metering liquid products containing solid parts which are supplied in a predetermined quantity to a package, comprising:

determining a metered quantity by opening and closing at least one valve having two independently moveable blocking elements (4, 5) that are both moveably mounted in a valve housing (3) so that a first of the blocking elements (4) is arranged inside the housing (3) and a second of the blocking elements (5) is arranged radially completely inside the entire first blocking element (4), wherein the first blocking element and the second blocking element are each configured as at least one wall segment of a hollow cylinder, wherein the housing (3) has a transverse axis (6) and wherein the blocking elements (4, 5) and the housing (3) are permanently positioned coaxially relative to each other and relative to the transverse axis (6) as sleeves with the second blocking element (5) being radially innermost, the housing (3) being radially outermost, and the entire first blocking element (4) being located radially between the housing (3) and the second blocking element (5), wherein the housing (3), the first blocking element (4) and the second blocking element (5) each have an opening facing perpendicular to the transverse axis, wherein, by a controllable or regulatable positioning of at least one of the cylindrical blocking elements (4, 5) arranged in the valve housing (3), at least one of the openings (9, 10) arranged in the area of side surfaces (7, 8) of the blocking elements (4, 5) makes available an opening or closing position and predetermines a cross-section of an outlet opening (12), wherein the first blocking element (4) has a first radius, the second blocking element (5) as a second radius and the housing (3) has a third radius, wherein all the radii are measured starting at the transverse axis (6), the first radius being smaller than the third radius and the second radius being smaller than the first radius, wherein the opening of the second blocking element (5) is limited by the cylinder wall segment (8) and the opening of the first blocking elements (four) is arranged between two cylinder wall segments (7, 14).

2. The method according to claim 1, wherein the blocking elements (4, 5) are positioned relative to each other through a rotary motion.

3. The method according to claim 1, wherein the blocking elements (4, 5) are arranged so as to be movable relative to each other in an axial direction.

4. The method according to claim 1, wherein a size of the outlet opening (12) is predetermined by an arrangement of the blocking elements (4, 5) relative to each other and relative to the valve housing (3).

5. The method according to claim 1, wherein by an arrangement of the blocking elements (4, 5) relative to each other and relative to the valve housing (3) a positioning of the outlet opening (12) is predetermined.

6. The method according to claim 1, wherein a size and positioning of the outlet opening are predetermined by an arrangement of the blocking elements (4, 5) relative to each other and relative to the valve housing (3).

7. The method according to claim 1, wherein sleeve-like blocking elements (4, 5) are positioned.

8. The method according to claim 1, wherein truncated cone-shaped blocking elements (4, 5) are positioned.

9. The method according to claim 1, wherein a size and/or a positioning of the positioning of the outlet opening (12) is predetermined by an axial displacement of at least one of the blocking elements (4, 5).

10. The method according to claim 1, wherein the products are at least in part liquid and are supplied in the predetermined quantity along a conveying path from a product storage to the package, wherein the valve housing is shaped at least partially as a sleeve, and wherein in at least one position of the valve the product flows through the valve housing as well as through both blocking elements.

11. A device for metering liquid products containing solid parts which are supplied in a predetermined quantity to a package, the device comprising:

at least one valve, which controls or regulates a product flow by opening and closing a conveying path, and has a valve housing in which at least one blocking element is positionably arranged in the conveying path, the valve housing having a transverse axis (6) and an opening facing perpendicular to the transverse axis, wherein, a first blocking element (4) as well as a second blocking element (5) are each configured as at least one wall segment of a hollow cylinder and each of the blocking elements is provided in the area of side surfaces (7, 8) with at least one opening (9, 10) each facing perpendicular to the transverse axis (6), wherein the blocking elements (4, 5) are permanently arranged essentially coaxially relative to each other and relative to the transverse axis (6) as sleeves, and wherein the two blocking elements (4, 5) are both moveably mounted in the valve housing (3) so that the first blocking element (4) is arranged inside the housing (3) and the second blocking element (5) is arranged radially completely inside the entire first blocking element (4), the second blocking element being radially innermost, he housing being radially outermost, and the entire first blocking element being located radially between the housing and the second blocking element, wherein the blocking elements are both independently moveable, wherein the first blocking element (4) has a first radius, the second blocking element (5) as a second radius and the housing (3) has a third radius, wherein all the radii are measured starting at the transverse axis (6), the first radius being smaller than the third radius and the second radius being smaller than the first radius, wherein the opening of the second blocking element (5) is limited by the cylinder wall segment (8) and the opening of the first blocking elements (four) is arranged between two cylinder wall segments (7, 14).

12. The device according to claim 11, wherein the blocking elements (4, 5) are arranged so as to be rotatable relative to each other.

13. The device according to claim 11, wherein the blocking elements (4, 5) are arranged longitudinally slideable relative to each other.

14. The device according to claim 11, wherein the blocking elements (4, 5) are arranged so as to be rotatable relative to the valve housing (3).

15. The device according to claim 11, wherein at least one of the blocking elements (4, 5) is constructed sleeve-like.

16. The device according to claim 11, wherein at least one of the blocking elements (4, 5) is constructed so as to be truncated cone-shaped.

17. The device according to claim 11, wherein at least one of the openings (9, 10) is defined by partial segments of a sleeve-like basic structure.

18. The device according to claim 11, wherein the products are at least in part liquid, wherein the valve is arranged between a product storage and the package, wherein the valve housing is shaped at least partially as a sleeve, and wherein in at least one position of the valve the product flows through the valve housing as well as through both blocking elements.

* * * * *